US005649365A

United States Patent [19]

Yang

[11] Patent Number: 5,649,365

[45] Date of Patent: Jul. 22, 1997

[54] BLADE AND COVER ASSEMBLY FOR A MULTIPLE FUNCTION CUTTING TOOL

[75] Inventor: Chi-Tung Yang, Taichung, Taiwan

[73] Assignee: Chi Mao Industrial Co., Ltd., Taichung, Taiwan

[21] Appl. No.: 590,427

[22] Filed: Jan. 23, 1996

[51] Int. Cl.[6] ..... B26B 11/00; B26B 25/00

[52] U.S. Cl. ..... 30/319; 30/151; 30/307; 7/158

[58] Field of Search ..... 30/118, 139, 143, 30/151, 287, 288, 307, 319; 7/118–120, 158, 161

[56] References Cited

U.S. PATENT DOCUMENTS 4,601,103 7/1986 Sugiyama ..... 30/319 X 5,144,749 9/1992 Chen ..... 30/319

5,438,757 8/1995 Weschenfelder ..... 30/139

*Primary Examiner*—Douglas D. Watts

*Attorney, Agent, or Firm*—Bacon & Thomas

[57] ABSTRACT

An assembly including a wheel-shaped cutting blade and protective cover may be attached to a multiple function cutting tool by inserting an engagement member of the assembly into a connecting chamber of the tool and securing the member to the tool with a screw. The protective cover is slidably mounted on a connecting member and disposable in either a first position for exposing the blade or a second position for concealing the blade.

1 Claim, 4 Drawing Sheets

BLADE AND COVER ASSEMBLY FOR A MULTIPLE FUNCTION CUTTING TOOL

BACKGROUND OF THE INVENTION

The present invention relates to a multiple-function cutting tool with movable safety device, especially to a multiple-function cutting tool comprising a knife body and a cutting tool set provided with a movable protective cover to protect both the cutting edge of the tool from damage and the person carrying of the tool from hurt.

Conventional cutting tools vary in kinds and uses. Each cutting tool has a different function for cutting different materials on various occasions. Thus, multiple-function cutting tools are available in the market to meet the various needs of the consummers. As shown in FIG. 1, a conventional multiple-function cutting tool consists of a knife body 1, a grindstone 11 on the lateral side to sharpen the edge of a blunt knife, a cutting blade 12 disposed beneath the grindstone 11 on the lower side of the knife body 1, and a hooked blade 121 disposed on the bottom of the knife body set 1 to unravel threads. The cutting blade 12 is pivotally jointed to the knife body 1 by a bolt 13 which can be screwed up or loosened to control the folding and unfolding of the cutting blade 12. Also a semi-circular groove 14 is disposed beneath the grindstone 11 and right in the middle section of the cutting blade for cutting electric wires when the wires are placed in the groove 14 and the tip of the cutting blade 122 is forcedly pushed inwards to cut through the wires. Two recesses 15 are disposed on the other lateral side of the knife body 1 for breaking heavier materials.

In addition to the cutting blade 12, a conventional multiple cutting tool, as shown in FIG. 1, is provided with a wheel-shaped knife blade 16 on top of the knife body 1 which, for the purpose of cutting, is exposed in part by the edge 161 outside the knife body 1 and is secured to the knife body 1 by a screw 17.

As shown above, the exposed cutting edge 161 of the wheel-shaped knife blade 16 is extremely dangerous when transporting the tool around. A multiple cutting tool should meet not only the requirement of multiple functional use but also the convenience of safe carrying. The present invention is then made in view of the drawbacks of the above conventional multiple function cutting tool.

SUMMARY OF THE INVENTION

It is, therefore, the primary object of the present invention to provide an improved multiple function cutting tool with a movable safety device, especially to a multiple cutting tool comprising a knife body and a cutting tool set provided with a movable protective cover to protect both the cutting edge of the tool and the carrier of the multiple-function cutting tool.

DETAILED DESCRIPTION OF THE PREFERRED EMBODIMENTS

Figure 1:
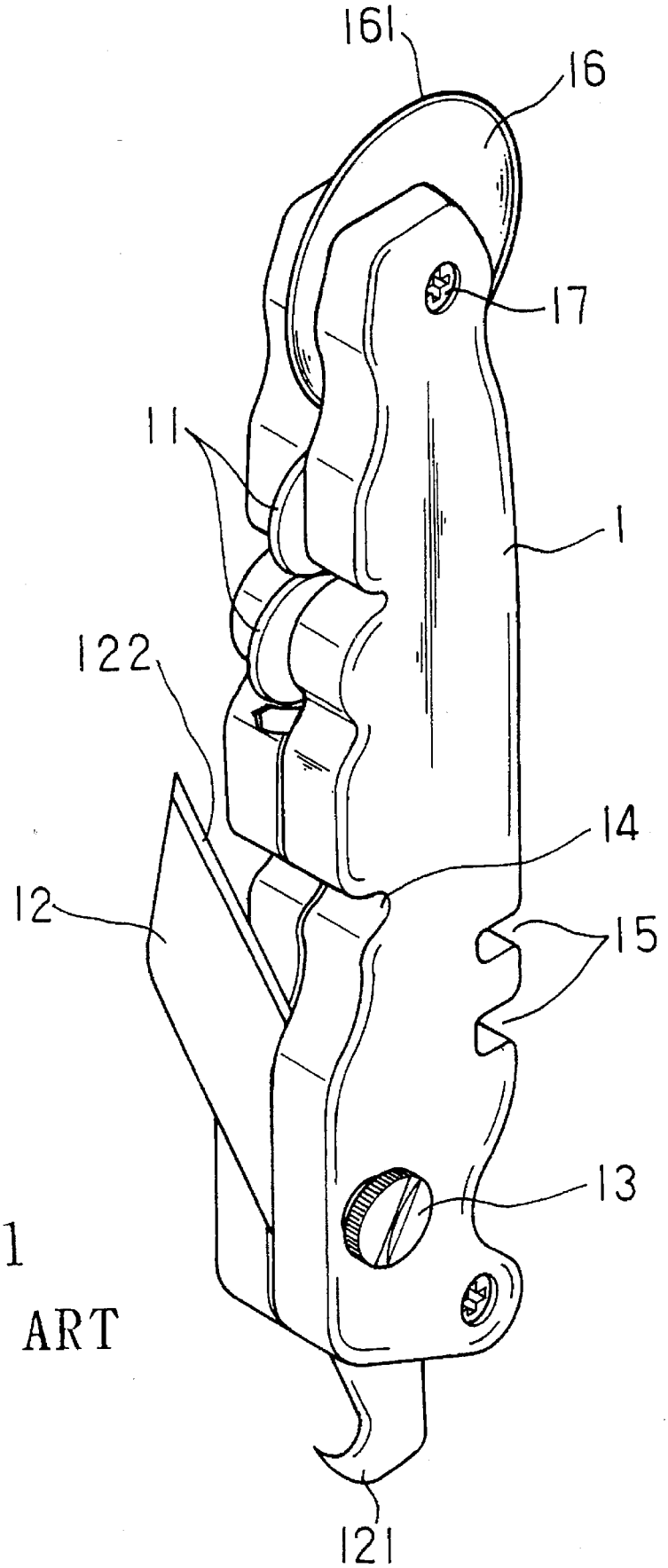
FIG. 1 PRIOR ART
FIG. 1 is a perspective view of a conventional multiple function cutting tool.
Figure 2:
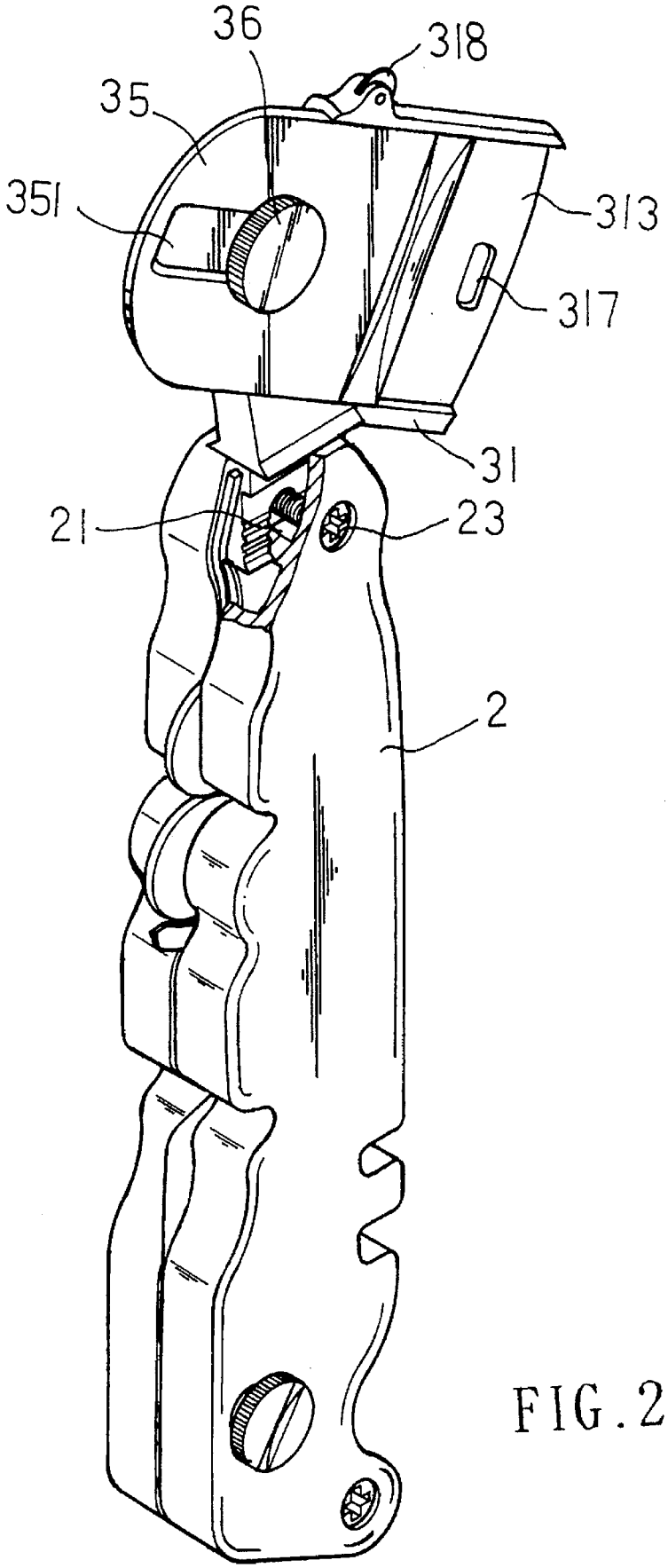
FIG. 2 is a perspective view of the present invention.
Figure 3:
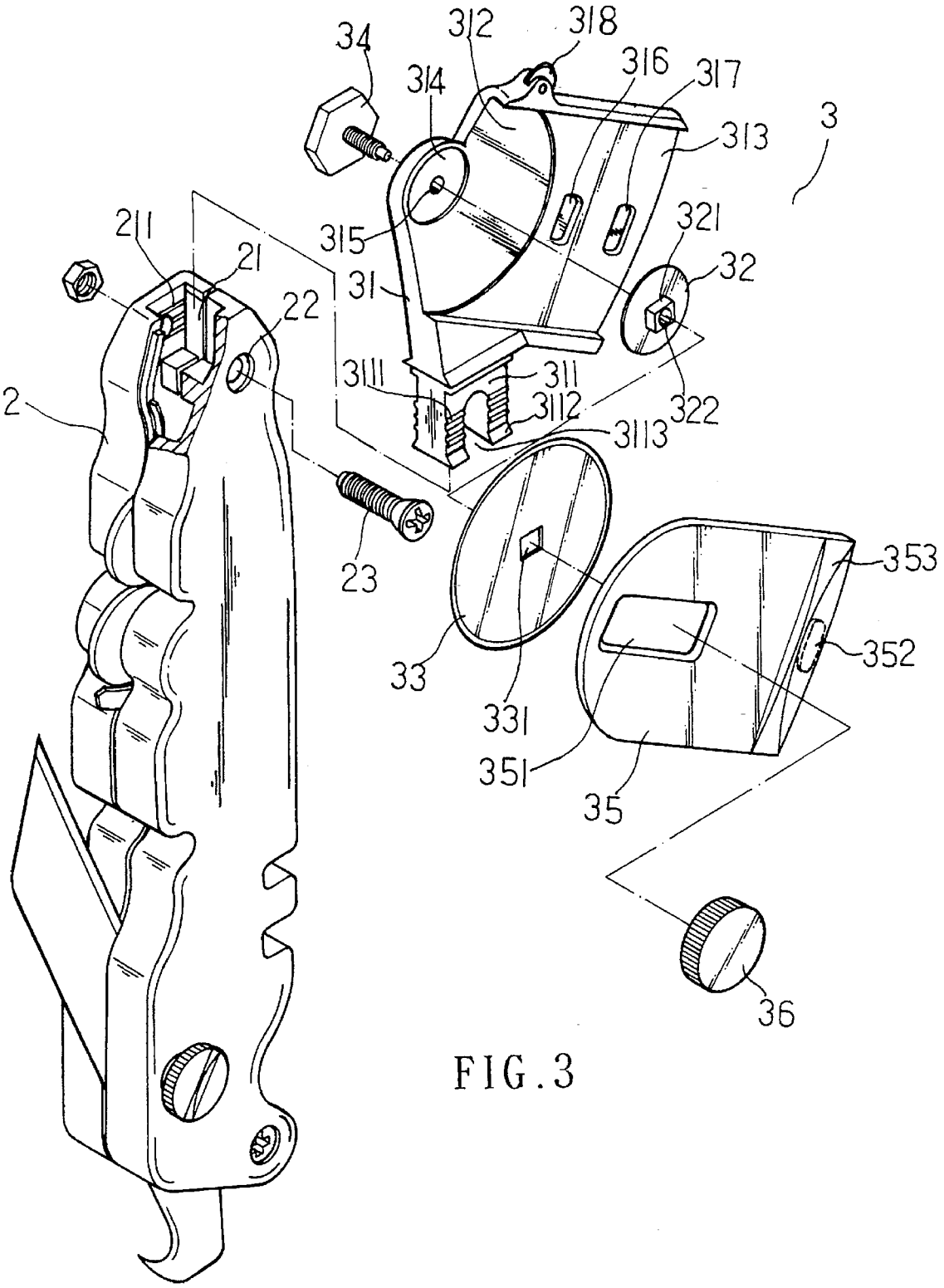
FIG. 3 is a perspective exploded view of the present invention.

Please refer to FIGS. 2 and 3. The present invention relates to a multiple-function cutting tool with a movable safety device, comprising a knife body 2 and a cutting tool set 3 secured to the knife body 2 by a screw. On the upper part of the knife body 2 is defined a connecting chamber 21 having a through hole 22 on either side of it and several stripes of engaging groove 21 on the inner side of it. The cutting tool set 3 consists of a connecting member 31 wherein a diamond cutter 318 is disposed at one end and an inverted U-shaped engagement member 311 defining a recess 3113 is disposed at the other end. Upon the inverted U-shaped engagement members 318 is disposed several stripes of protruding flanges 3111 which, together with two protruding blocks 3112 disposed at the feet of the inverted U-shaped engagement members 318, are to engage with the engaging groove 211 inside the connecting chamber 21 when a screw 23 is used to secure the connecting member 31 to the knife body set 2 by passing the through-hole 22 of the knife body set 2 and the recess 3113 formed by the inverted U-shaped engagement member 318. A partial circular-shaped blade groove 312 and a slide groove 313 are provided at the upper part of the connecting member 31, and the blade groove 312 is provided with a round recess 314 with a through hole 315 at the center thereof. A protective washer 32 having at the center thereof a rectangular protruding block 321 which is provided with a screw hole 322 thereupon is jointed to the round-shaped engaging groove 314 by a bolt 34 passing the through hole 315 and the screw hole 322 of the protective washer 32. A wheel-shaped blade 33 can be rotatably engaged to the rectangular protruding block 321 of the protective washer 32 thereof by means of a rectangular hole formed in blade 33. At one side of the blade groove 312 is fixed a slide groove 313 upon which a first locating cavity 316 and a second locating cavity 317 are arranged in parallel.

A movable protective cover 35 provided with an elongated slot 351 formed therein can be fixed to the blade groove 312 and the slide groove 313 by means of a nut 36 having a diameter larger than the width of the elongated slot 351. The nut can be tightened up or loosened on bolt 34 to adjust the movement of the movable protective cover 35 upon the slide groove 313. At one end of the movable protective cover 35 is disposed a pushing flange 353 while at the reverse side thereof is provided with a stopping block 352 corresponding to and selectively engageable with either the first locating cavity 316 or the second locating cavity 317 of the slide groove 313 when the movable protective cover 35 is moved along the slide groove 313.

Figure 4:
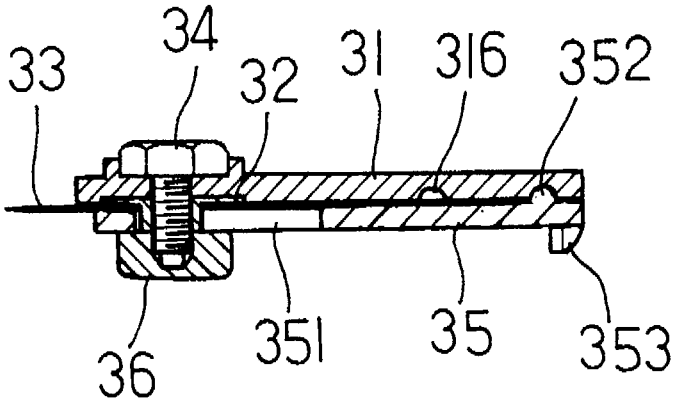
FIG. 4 is a diagram showing the movable protective cover of the present invention in a first position exposing a knife blade.

Please referring to FIG. 4, when the wheel-shaped blade is in use, the nut 36 upon the elongated slot 351 is loosened and the pushing flange 353 is pushed backwards. The movable protective cover 35 will slide backwards by means of the sliding groove 313 of the connecting member 31 until the stopping block 352 of the movable protective cover engages with the second locating cavity 317 in the sliding groove 313. When the movable protective cover 35 is placed in position, the nut 36 can then be tightened up and the wheel-shaped blade 33 will be revealed and exposed outside the movable protective cover for easy cutting.

Figure 5:
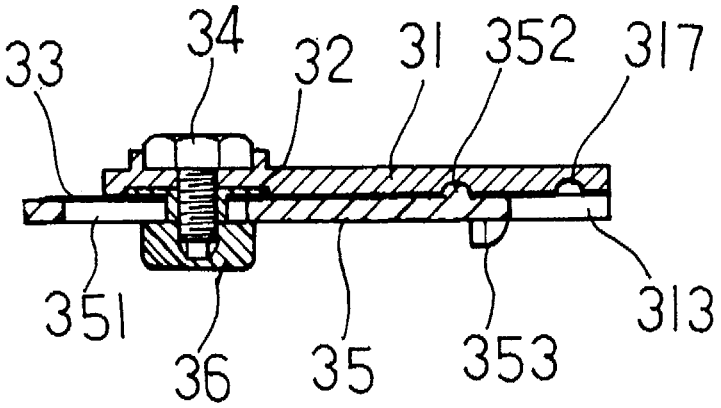
FIG. 5 is another diagram showing the movable protective cover of the present invention in a second position concealing a knife blade.

Please referring to FIG. 5, when the wheel-shaped blade 33 is not in use, the nut 36 upon the elongated slot 351 can be loosened again and the pushing flange 353 of the movable protective cover 35 be pushed forwards along the slide groove 313 until the stopping block 352 engages with the first locating cavity 316. When the movable protective cover reaches a set position, the nut 33 can be tightened up again to fix the movable protective cover 35 to the wheel-shaped blade 33 concealing and protecting the edge of the exposed wheel-shaped blade 33 so as to ensure the safety of both the cutting tool and the carrier of the tool.

What is claimed is:

1. A blade and cover assembly for a multiple function cutting tool having a connecting chamber, which assembly comprises:

a) a connecting member including an engagement member for insertion within the connecting chamber of the multiple function cutting tool, a circular-shaped blade groove, a round recess formed in the blade groove, a central hole extending through a bottom of the round recess, a washer disposed within the round recess, the washer including first and second a rectangular block and a central hole extending through the rectangular block, and a slide groove, the slide groove having a pair of spaced cavities formed therein;

b) a wheel-shaped blade disposed in the blade groove, the blade including a central rectangular-shaped hole, and the rectangular block of the washer being engaged within the rectangular-shaped hole;

c) a protective cover having an exterior surface and an interior surface, and including an elongated slot formed therein, a flange on the exterior surface and a stopping block on the interior surface; and d) an adjustable fastener means extending through the central hole of the round recess, central hole of the washer, rectangular-shaped hole of the blade and elongated hole of the protective cover for securing same together, whereby loosening of the fastening means permits the cover to be selectively moved between a first position, wherein the stopping block engages the first cavity for concealing the blade, and a second position, wherein the stopping block engages the second cavity for exposing the blade.

* * * * *